United States Patent [19]

Murray

[11] 3,960,191

[45] June 1, 1976

[54] FASTENER FEEDING AND DRIVING ATTACHMENT

[75] Inventor: Pierre Charles Murray, DeKalb, Ill.

[73] Assignee: Illinois Tool Works Inc., Chicago, Ill.

[22] Filed: June 17, 1975

[21] Appl. No.: 587,796

[52] U.S. Cl. ..... 144/32 R; 29/211 R; 29/240; 81/57.37; 221/289

[51] Int. Cl.[2] ..... B27B 17/00

[58] Field of Search ..... 29/240, 211 R, 526; 81/57.37, 52.4, 57.23; 227/118, 138; 221/289, 179; 144/32; 206/343, 346, 544; 173/107

[56] References Cited

UNITED STATES PATENTS

| | | | |
|---|---|---|---|
| 1,717,402 | 6/1929 | Pope | 227/118 |
| 1,793,236 | 2/1931 | McDonough | 81/57.37 |
| 1,839,490 | 1/1932 | Moeller | 221/179 |
| 2,989,996 | 6/1961 | Dixon | 81/52.4 R |
| 3,249,280 | 5/1966 | Cabot et al. | 227/138 X |
| 3,524,484 | 8/1970 | Miller | 144/32 |
| 3,581,370 | 6/1971 | Passarella | 144/32 |
| 3,587,683 | 6/1971 | Bangerter | 144/32 |

*Primary Examiner*—Travis S. McGehee
*Assistant Examiner*—W. D. Bray
*Attorney, Agent, or Firm*—Thomas W. Buckman; Robert W. Beart

[57] ABSTRACT

An attachment for a portable power screwdriver allowing a workman to drive screws from a stand-up position. A telescoping driving tube is associated with a power driver and the tube being joined to a feed tube in the region of a nose section. The feed tube includes an escapement device which is responsive to a reciprocating movement of a cam fixed on an upper driving tube portion relative to a lower driving tube portion to ensure a non-jamming feeding of fasteners to the nosepiece.

11 Claims, 13 Drawing Figures

FASTENER FEEDING AND DRIVING ATTACHMENT

BACKGROUND OF THE INVENTION

This invention relates generally to a power screwdriver and more particularly to a portable-type screwdriver where fasteners are automatically fed to a driving position.

There are a number of tools adapted to sequentially drive threaded fasteners wherein the fasteners are automatically fed to a position beneath a driving spindle in readiness for the next operating stroke. However, most of these devices are designed for stationary operation where the work to be fastened is brought to the driver. These devices are clearly unacceptable for use as portable power tools. Efforts to provide a portable screwdriver capable of automatically feeding fasteners to the nosepiece have primarily been concerned with developing an integrated driving unit wherein the driving energy is also used to positively feed fasteners to their operative positions.

It is, accordingly, an object of this invention to provide a driving tool which enables a workman to fasten a screw to a workpiece while the workman remains in a standing or substantially standing position.

A further object of the invention is the provision of an attachment to a conventional electric powered rotary screwdriver, thereby facilitating its use on a construction site.

Still a further object of the invention is the provision of a driving attachment incorporating a gravity feed tube.

An advantage of the invention is a novel feed control device which insures that only a single fastener is fed to the nosepiece for each driving stroke.

In general, these objects are obtained by a Y-shaped attachment including a driving spindle located in one section of the Y and a feed tube comprising the other section of the Y. The driving spindle is adapted for operative connection with a fastener driving tool at an upper tubular portion of the attachment. The upper tubular portion and driving spindle are further mounted for reciprocatory and telescopic movement downwardly relative to a lower tubular portion which is integrally connected to a nosepiece. The movement of the upper tube activates an escapement device which feeds fasteners from the feed tube to the nosepiece with the feeding being accomplished during the return, upward stroke of the spindle.

DESCRIPTION OF THE PREFERRED EMBODIMENT

Figure 4:
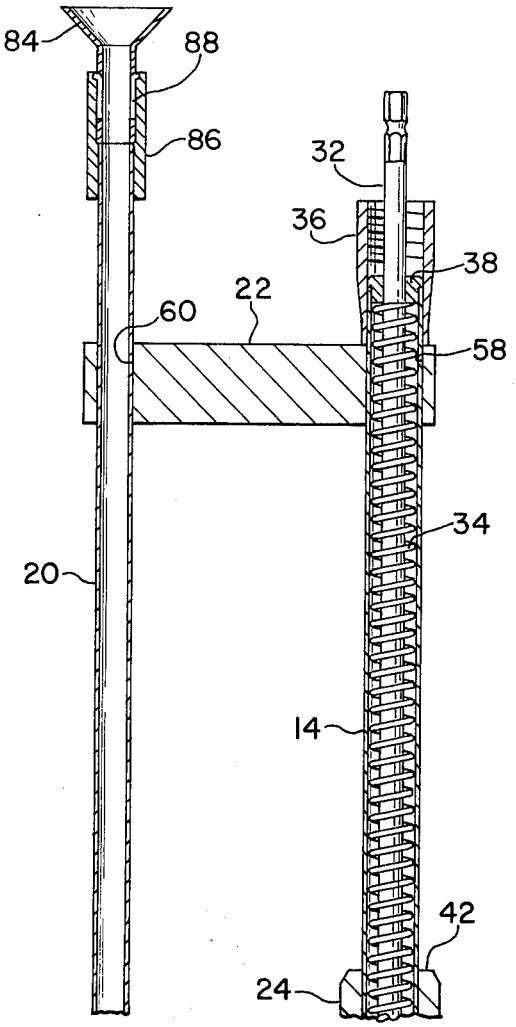
FIGS. 3 and 4 are enlarged sectional views of the lower and upper portions of the attachment respectively with the elements thereof corresponding to the position of the attachment shown in FIG. 1.

Referring to the drawings in which similar reference numerals represent similar parts in the several views, an attachment for a conventional electric power rotary tool is generally denoted by the numeral 10 mounted on a rotary tool 12. The attachment 10 will include several elements which contribute to enabling a workman to drive threaded fasteners into a workpiece with a minimum of effort. The attachment can be shown most clearly in FIGS. 1, 3 and 4 as having a generally Y-shaped configuration with one arm of the Y being connected to the driving spindle of the tool 12 and the other arm of the Y forming a feed tube for successively placing fasteners in the common portion of the Y serving as the nosepiece.

Figure 2:
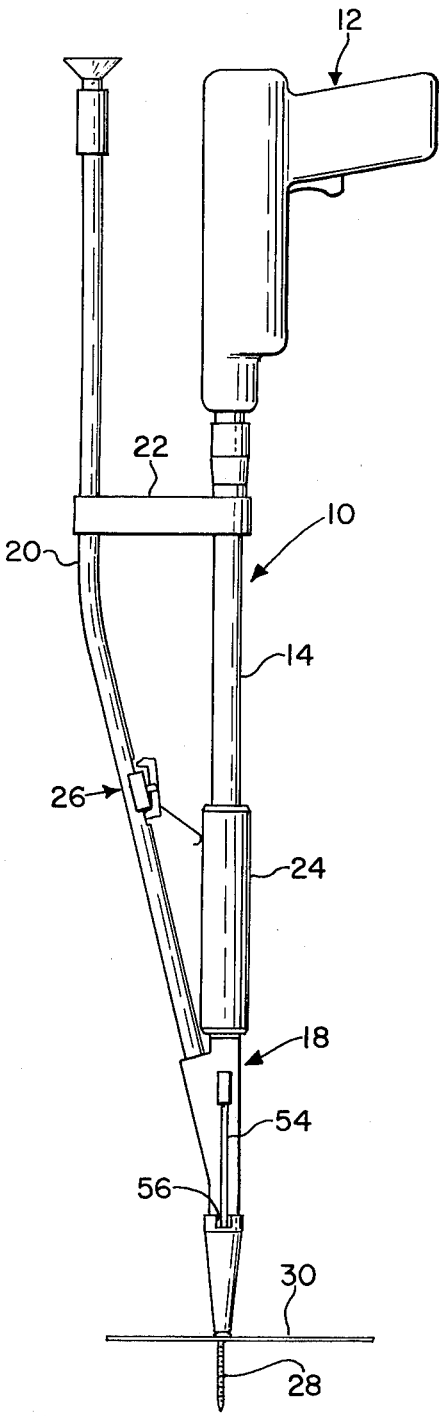
FIG. 2 is a side elevational view of the attachment at the bottommost portion of its driving stroke.

The tube housing the driving spindle portion of the attachment is basically a two-piece device comprising an upper tubular section 14 and a lower tubular section 16. The driving spindle 32 is housed within the bore of both of these tube sections and is operatively connected at its upper end to the driving chuck of the tool 12 so as to transmit torque from the tool to the fastener to be driven. The upper tubular section is biased upwardly from the lower tubular section by a coil spring 34 which is mounted around the spindle and positioned therein by an upper stop portion 38 and the top edge 40 of the lower tube 16. A coupling 36 is fixedly attached to the upper portion of the tube element 14 and is adapted to be attached to the tool 12. The spindle 32 is of such a length that when the upper tube is at rest position the spindle is retracted from the nosepiece section 18 of the attachment. The upper tube 14 is mounted to be telescopically movable over the lower tube 16 so that when pressure is exerted on the upper tube in the axial direction the spindle 32 and upper tube 14 will be forced downwardly relative to the lower tube portion 16 and nosepiece 18 as well as to the feed tube section 20. This driving sequence is best illustrated in FIG. 2.

The feed tube 20 extends upwardly and outwardly from the Y connection 46 forming part of the nosepiece 18. The free extremity of the feed tube may have a funnel-shaped mouth 84 to facilitate the placement of fasteners in the tube. The cylindrical feed tube may be supported relative to the other portions of the attachment by a sliding collar support member 22. A clearance hole 60 enables the collar to slide relative to the tube 20 while a press fit 58 over a certain peripheral portion of the upper tube forces the collar to move axially with the tube 14.

Figure 1:
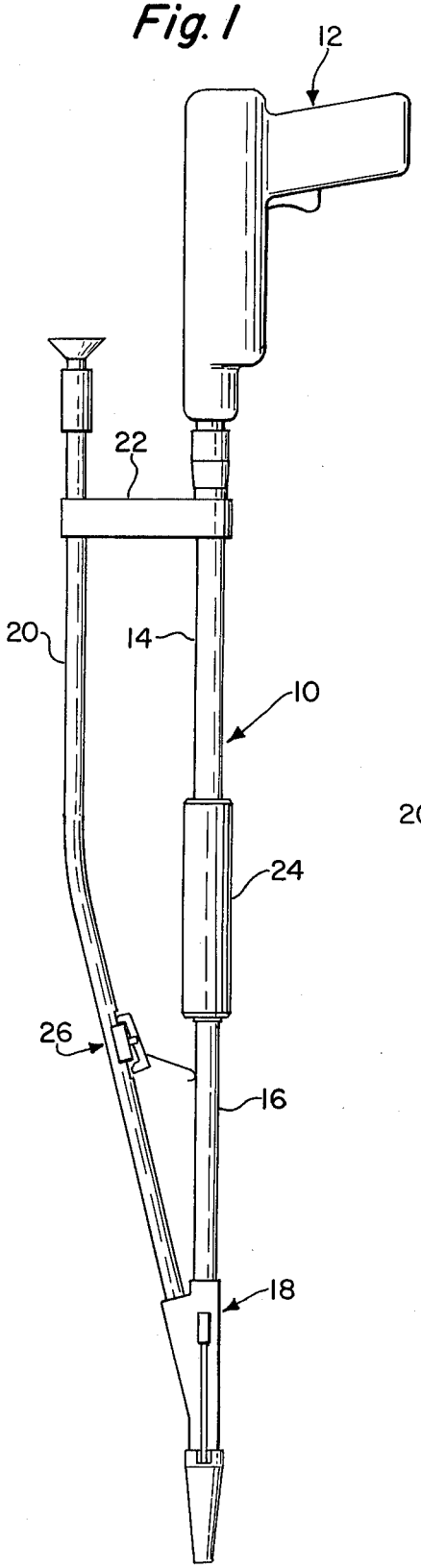
FIG. 1 is a side elevation view of the attachment and an associated driving tool at rest position.
Figure 3:
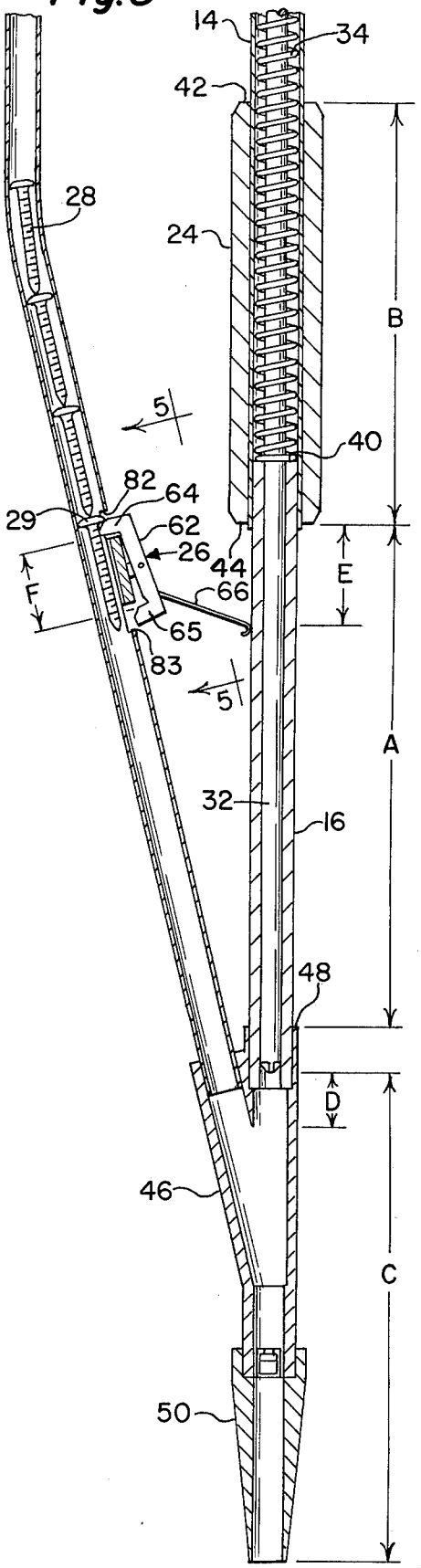
Figure 5:
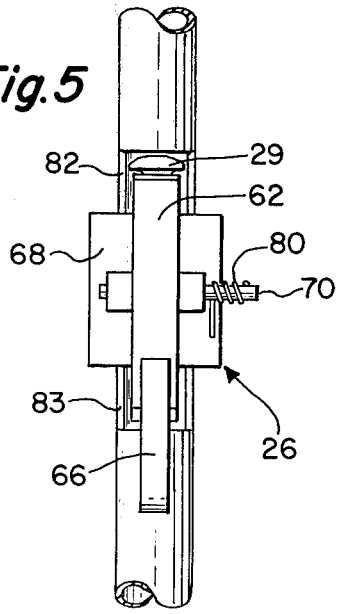
FIG. 5 is a fragmentary sectional view of the device taken along the line 5—5 of FIG. 3.
Figure 6:
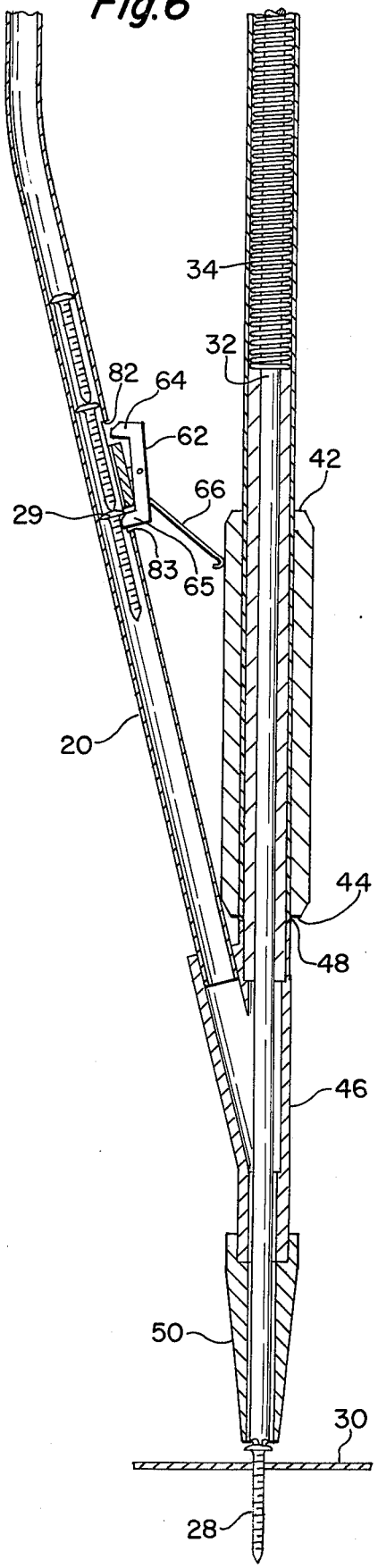
FIG. 6 is an enlarged fragmentary sectional view of the attachment with the elements thereof shown in a position corresponding to the position of the attachment shown in FIG. 2.

The fasteners 28 which are stored in axial relationship to one another in the feed tube are automatically fed to a position in the nosepiece 18 during the driving cycle and in such a manner as to preclude a plurality of such fasteners being placed in the nosepiece at one time. Generally, the fasteners are fed into operative position during the portion of the driving cycle when the upper tube section 14 is returning to its at rest upper position following the driving of a fastener. This feeding is accomplished through the use of a cylindrical cam portion 24 mounted on the upper tube in operative cooperation with an escapement device 26 mounted on the feed tube. The escapement device 26 is basically a two-position apparatus wherein a pivotable arm 62 includes a pair of stop ears 64 and 65 extending inwardly toward the feed tube. The ears 64 and 65 are mounted for registration in apertures 82 and 83 respectively of the feed tube. When the ears 64 and 65 are positioned in their respective apertures 82 or 83, the free flow of fasteners through the bore of the feed tube is obstructed. The arm 62 pivots about a pin 70 and is biased, through a coil spring 80, so that the upper ear 64 tends to be inserted in the aperture 82 as shown in FIGS. 1 and 3. A finger member 66 extends outwardly from the extremity of the arm adjacent the stop ear 65 and is operative to selectively pivot the arm 62 against the bias of the spring so that the ear 65 is positioned within its corresponding aperture 83. This position in the feed cycle is shown in FIGS. 2 and 6. The activation of this escapement device is accomplished by the longitudinally extending cylindrical cam 24 which is fixedly mounted adjacent the lowermost extremity of the upper tube 14. The lower extremity 44 of the cam is spaced axially from the tip of the activating finger 66 when the attachment is in an unstressed position as shown in FIG. 3.

Figure 7:
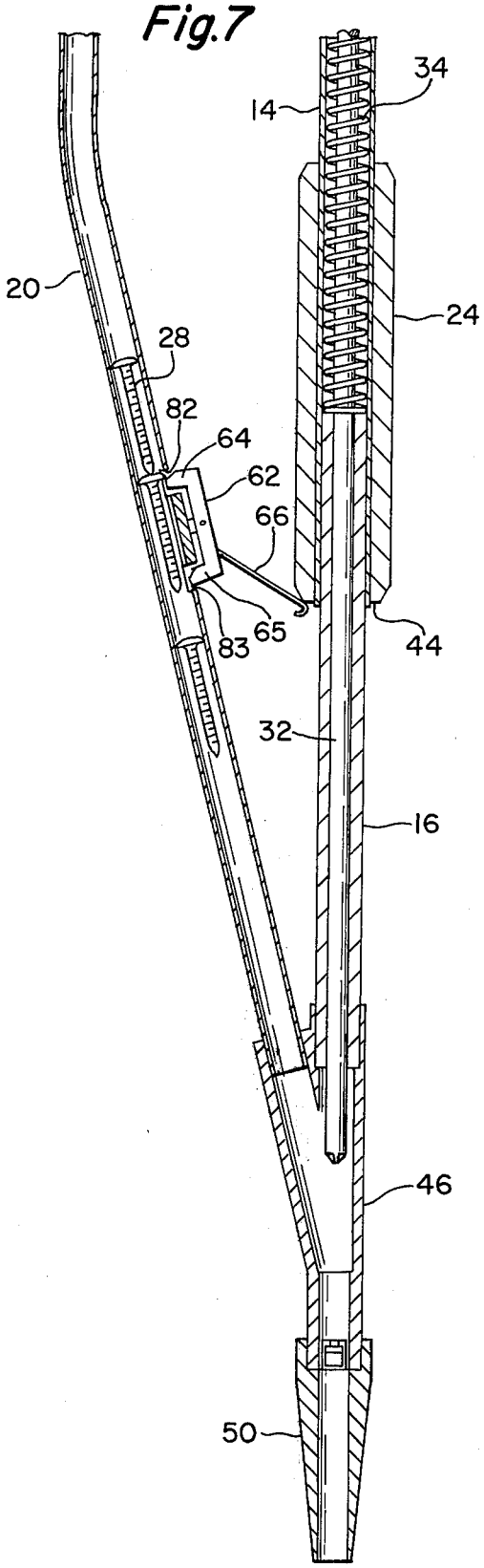
FIG. 7 is an enlarged fragmentary sectional view of the attachment with the various elements thereof shown in a further position in the driving cycle.

The feed sequence can best be described with reference to FIGS. 3, 6 and 7. In FIG. 3 the position of the escapement device and screws 28 represent basically the at rest position of the tool and attachment as shown in FIG. 1. It should be understood that in order to place a fastener 28 in the nosepiece, in readiness for driving by the spindle 32, the driving tool, spindle and upper tube should be forced axially downwardly by the workman. During this downward movement, the cam 24 will contact the activating finger 66 and will continue to contact the finger during the driving cycle, as shown in FIG. 6. The contact of the cam with the finger causes the escapement arm to pivot against the resistance of the spring 80 so that the lowermost ear 65 extends into the aperture 83. The screw 28 will have been released from its position shown in FIG. 3 to be retained in the position shown in FIG. 6 by the abutment of the lowermost stop ear 65 with the fastener head 29 as the spindle 32 drives the previously positioned fastener through the nosepiece.

Upon the completion of the driving of this fastener, the axial pressure is released by the workman and the upper tube is forced upwardly by the bias of the coil spring 34. As the lower extremity 44 of the cam 24 passes the tip of the finger 66, the head of the fastener is released from the ear 65 and is free to fall into position in the nosepiece. The instantaneous position of the various elements of the attachment during this portion of the feed sequence will be shown in FIG. 7 with the next positioning of the fastener relative to the escapement device understood to be identical to that shown in FIG. 3.

Figure 8:
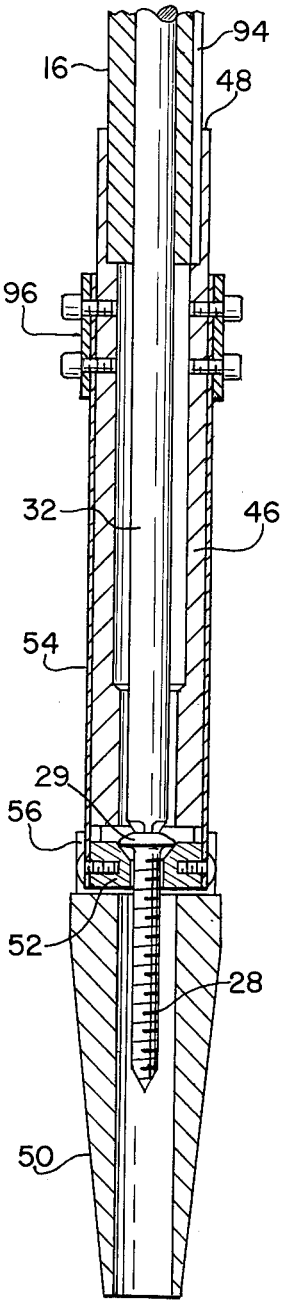
FIG. 8 is an enlarged sectional view of the nosepiece of the invention during one stage of the driving cycle.
Figure 9:
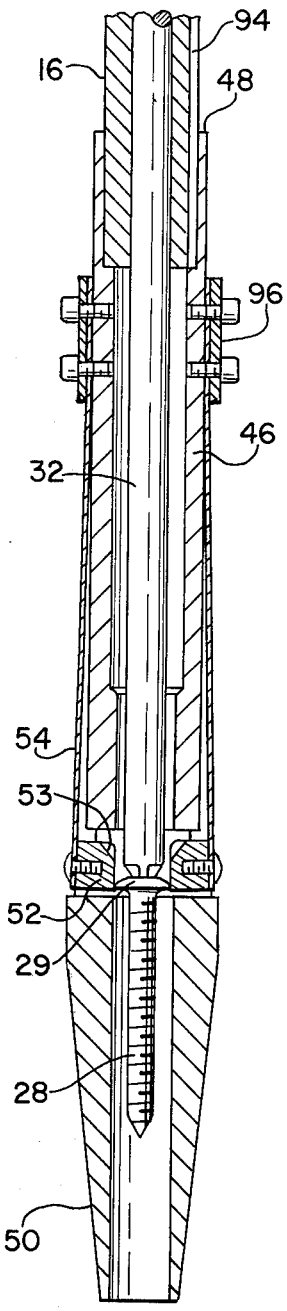
FIG. 9 is an enlarged sectional view of the nosepiece of the invention during a stage in the driving cycle subsequent to that shown in FIG. 8.
Figure 10:
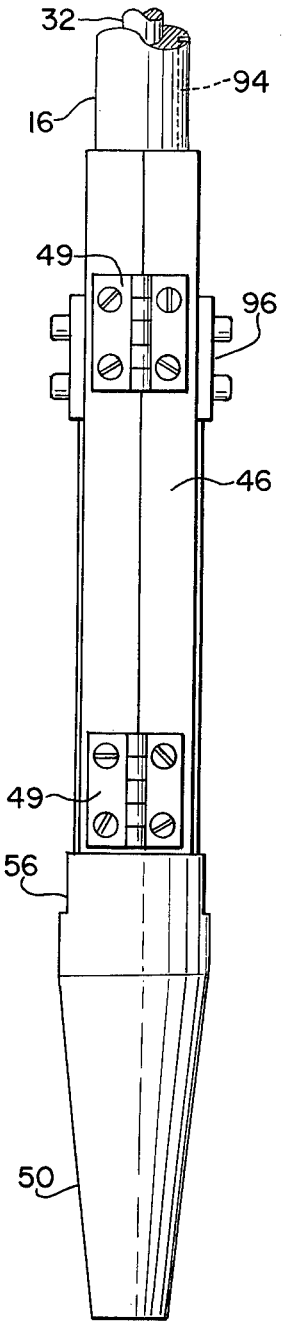
FIG. 10 is an enlarged rear elevational view of the nosepiece section of the invention.

The fastener 28 is retained within the nosepiece 50 and protected from dislodgment thereby through the use of spring loaded jaws 52. This relationship is shown in FIGS. 8 and 9. Leaf springs 54 are attached to either side of the Y connection 46 at the upper portion thereof by suitable attachment means 96. The free extending extremities of the spring are fixedly attached to the jaw portions which are free to pivot in slots 56 formed in the nose section 50. The jaws will include a conical seating section 53 which receives the head of the fastener and serves as the structure permitting the jaws to be cammed outwardly as shown in FIG. 9 as the spindle drives the fastener through its jaws. As the spindle is retracted, the jaws will be urged inwardly and positioned to receive the head of the next fastener 28 to be fed thereto. The Y connection 46 may be formed of two identical halves hinged at one side by suitable hinges 49 allowing the joint to be conveniently opened.

Figure 11:
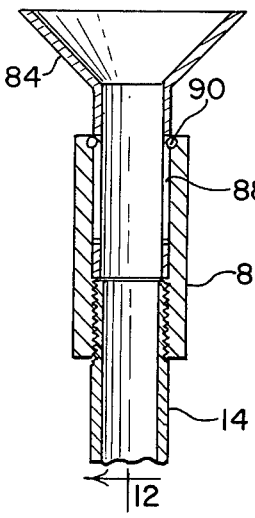
FIG. 11 is an enlarged fragmentary sectional view of the mouth portion of the feed tube.
Figure 12:
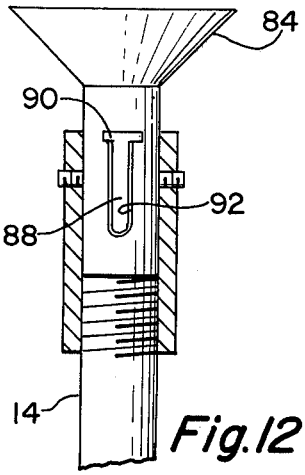
FIG. 12 is an enlarged fragmentary sectional view of the mouth portion of the invention taken along the line 12—12 of FIG. 11.
Figure 13:
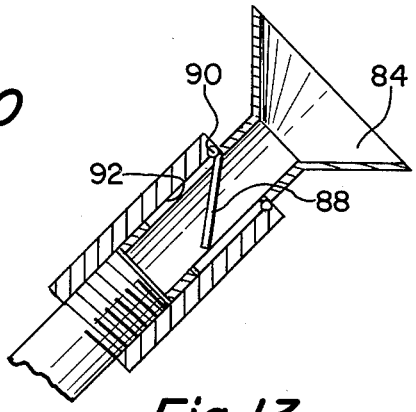
FIG. 13 is an enlarged sectional view of the mouth portion similar to that shown in FIG. 11 and showing the mouth tilted at an angle.

A further aspect of the invention will be described relative to the funnel-shaped mouth of the feed tube. With reference to FIGS. 11–13, it will be seen that a collar 86 is secured to the upper portion of the feed tube and also serves as a mounting for the funnel 84. The side walls of the body of the funnel are provided with longitudinal slots 92 to receive a pair of freely pivoting flat valves 88. A pivot pin 90 is integrally secured to each of the flat valves of the upper extremity thereof and mounted in a recess formed at the inner periphery of the collar 86 so that when the feed tube is in a generally vertical position the flap valves 88 assume the position generally shown in FIGS. 11 and 12 and do not obstruct the bore of the tube. However, when the attachment 10 and the feed tube is inclined relative to a vertical position, one of the flap valves 82 will freely swing into the bore as shown in FIG. 13 to prevent exiting of fasteners which are housed within the feed tube. This feature thus prevents accidental spillage of fasteners from the feed tube when the attachment is manipulated out of working position by the workman.

The attachment 10 incorporates various dimensional relationships between several elements which contribute to the capability of the attachment to efficiently feed fasteners during a driving cycle in a non-jamming manner. For this purpose, the longitudinal dimension B defining the length of the cam 24 will be referred to as a first longitudinal dimension. The distance between the lowermost extremity 44 of the cam and the stop formed by the uppermost extremity 48 of the Y connector, when the attachment is in an at rest position, will be identified as dimension A and representing a second axial dimension. The dimension C representing the at rest position of the lower extremity of the spindle from the lower extremity of the nosepiece will be referred to as a third axial dimension. A fourth axial dimension E represents the distance between the lower extremity 44 of the cam 24 and the tip of the finger 66 when the attachment is in at rest position. The axial dimension D represents the distance between the tip of the driving spindle 32, when in at rest position, and the lowermost region of the Y joint separating the feed tube from the driving spindle.

It has been found that the following relationships between these dimensions will insure the most efficient operation and contribute to the non-jamming capability of the attachment. Dimension A should be greater than or equal to dimension C to allow the screw head to seat properly against the workpiece. Preferably, dimension A should be substantially equal to dimension C to eliminate overdriving the fastener. If dimension A were less than dimension C, the spindle would stop its downward motion before the screw is completely set. The length of the cam B should be greater than the distance A minus the distance E in order to eliminate multiple feeding of fasteners during a single stroke. The finger 66 could possibly release a screw while the spindle blocks its path to the nosepiece if this relationship were not present in the attachment. A further refinement of this relationship indicates that the dimension D should be greater than or equal to the dimension E or a fastener will release when the lowermost extremity of the driving spindle is still in the common bore of the Y connection. The dimension F representing the length of the arm 62 on the escapement device should generally be greater than the length of the screw associated therewith in order to insure that only a single fastener is fed per driving cycle.

Thus it is apparent that there has been provided, in accordance with the invention, an attachment for an electric power driving tool that satisfies the objects, aims and advantages set forth above. While the invention has been described in conjunction with specific embodiments thereof, it is evident that many alternatives, modifications and variations will be apparent to those skilled in the art in light of the foregoing descriptions. Accordingly, it is intended to embrace all such alternatives, modifications and variations as fall within the spirit and broad scope of the appended claims.

I claim:

1. A portable power fastener driving tool including a driving spindle located within tubular means for axial and rotative movement therein, a feed tube associated with and connected to the tubular means for supplying fasteners to be driven by the spindle, a nose portion adapted to abut a workpiece and including a Y connection including a pair of upper arm sections and merging to a common bore section for coupling the tubular means to the feed tube at the lowermost extremity of the tool, the tubular means including an upper tube member coupled to suitable power supply means and a lower tube member at one of the said upper arm sections of the nose portion, the upper and lower tube members being mounted for relative reciprocating telescopic movement, spring means associated with the tubular means to bias the spindle and upper tube element upwardly from the Y connection, the upper tube element including a cam of predetermined axial dimension fixedly mounted thereon, a two position, pivotable escapement device mounted on the feed tube including means for selective activation to one of the two positions by the cam so that the spindle may be moved downwardly to an operative position within the nosepiece while the escapement controls the feeding of fasteners thereto.

2. A driving tool in accordance with claim 1, wherein the cam is a sleeve having said predetermined axial dimension and having a diameter greater than the outer diameter of the upper tube member and fixedly attached thereto at the lowermost extremity thereof.

3. A driving tool in accordance with claim 1, wherein the escapement includes a lever with a pair of spaced ears extending inwardly, the lever pivotally mounted midway the ears so that the ears will selectively register with a pair of spaced apertures in the feed tube whereby the positioning of an ear in its associated aperture restricts free passage of fasteners through the feed tube.

4. A driving tool in accordance with claim 3, wherein a finger is fixedly attached to the lever at a position spaced from the pivotal mounting and extending outwardly from the feed tube toward the tubular means, the outermost extremity of the finger being spaced downwardly from the lowermost extremity of the cam when the upper tube member is in rest position.

5. A driving tool in accordance with claim 1, wherein the Y connection includes a stop means spaced axially downwardly from the cam when the upper tube member is in rest position to limit the downward movement of the upper tube element over the lower tube element.

6. A driving tool in accordance with claim 1, wherein the lowermost extremity of the driving spindle is spaced upwardly from the uppermost extremity of the common bore of the Y connection when the upper tube member is in rest position to allow entry of fasteners to the nose portion.

7. A driving tool in accordance with claim 1, wherein the feed tube is provided with a funnel mouth.

8. A driving tool in accordance with claim 1, wherein the feed tube includes a flap valve means to permit entry of fasteners to the tube but precludes exit from the mouth thereof.

9. A driving tool in accordance with claim 1, wherein a guide means is fixed to the upper tube element for axial movement therewith, the feed tube mounted therein for restricting the lateral movement of the feed tube relative to the tubular means.

10. A driving tool in accordance with claim 1, wherein the cam includes a region effectively increasing the radial dimension of the upper tube member facing the feed tube for a first predetermined axial dimension, the nosepiece including a stop means for limiting the downward movement of the upper tube member over the lower tube member, the stop means being spaced downwardly a second predetermined axial dimension from the lowermost extremity of the cam when the upper tube member is in rest position and the lowermost extremity of the driving spindle, when in rest position, being spaced a third predetermined axial dimension from the workpiece abutting extremity of the nosepiece wherein the second dimension is not greater than the third dimension to allow a fastener head to be sealed against the workpiece.

11. A driving tool in accordance with claim 10, wherein the means for activating the escapement in response to the cam is spaced downwardly from the lowermost extremity of the cam, when the upper tube member is in rest position, a fourth predetermined axial dimension, said second dimension minus said fourth dimension being less than the first dimension to prevent the feeding of more than one fastener to the nosepiece during a single operative stroke of the tool.

* * * * *